United States Patent [19]

Smith

[11] Patent Number: 4,566,840

[45] Date of Patent: Jan. 28, 1986

[54] MECHANISM FOR DUMPING A CONTAINER INTO A REFUSE COLLECTION VEHICLE

[75] Inventor: Fred T. Smith, Palos Verdes Pennisula, Calif.

[73] Assignee: The Heil Co., Milwaukee, Wis.

[21] Appl. No.: 643,670

[22] Filed: Aug. 22, 1984

Related U.S. Application Data

[63] Continuation of Ser. No. 368,529, Apr. 15, 1982, abandoned.

[51] Int. Cl.[4] ..... B65F 3/04

[52] U.S. Cl. ..... 414/408; 414/420; 414/549; 414/555

[58] Field of Search ..... 414/403, 404, 406, 408, 414/409, 419, 420, 421, 552, 546, 549, 555, 786

[56] References Cited

U.S. PATENT DOCUMENTS

| | | | |
|---|---|---|---|
| 4,281,956 | 8/1981 | Pickrell | 414/420 |
| 4,459,075 | 7/1984 | Eichenberger | 414/555 X |
| 4,479,751 | 10/1984 | Wyman et al. | 414/420 |

FOREIGN PATENT DOCUMENTS

| | | | |
|---|---|---|---|
| 2920898 | 12/1980 | Fed. Rep. of Germany | 414/408 |

*Primary Examiner*—L. J. Paperner
*Assistant Examiner*—Janice Krizek
*Attorney, Agent, or Firm*—Michael, Best & Friedrich

[57] ABSTRACT

A dumping mechanism including a support frame having a vertical leg and a horizontal leg extending from the upper end of the vertical leg. A container lift arm is supported from the horizontal leg of the frame by means of a link member. A container gripping means movable between a gripping position and a release position is mounted on one end of the lift arm. A guide track member is pivotally connected at its upper end to the horizontal leg of the frame and is engaged with a roller on the lift arm to guide the movement of the lift arm. A power lift cylinder is pivotally connected at its upper end to the horizontal leg of the frame and is pivotally connected at its lower end to the end of the lift arm opposite from that upon which the gripping means is mounted. The power cylinder when energized moves the lift arm between a position for gripping a container when in a standing position and a position wherein the container is inverted for dumping its contents into a refuse vehicle. A power track cylinder is pivotally connected at one end to the vertical leg of the support frame and pivotally connected at its other end to the guide track member. The power track cylinder when energized moves the lift arm so that the end on which the gripping means is mounted moves laterally in a direction substantially horizontal to the surface upon which the container is standing.

14 Claims, 9 Drawing Figures

MECHANISM FOR DUMPING A CONTAINER INTO A REFUSE COLLECTION VEHICLE

This is a continuation of application Ser. No. 368,529 filed Apr. 15, 1982, now abandoned.

BACKGROUND OF THE INVENTION (1) Field of the Invention

The invention relates to a mechanism for moving a container from a standing position to a dump position. More particularly, the invention relates to a mechanism mounted on a refuse collection vehicle for lifting a container from a standing position at one side of the vehicle to an inverted position over the vehicle for dumping the contents of the container into a receiving chamber on the vehicle.

(2) Description of the Prior Art

Prior mechanisms for lifting and dumping a container into a refuse collection vehicle are shown in U.S. Pat. Nos. 4,227,849, 3,910,434 and 3,773,197. Such prior mechanisms are of relatively complex construction and require a relatively long period of time for operation thru the dumping cycle.

As will be appreciated from the following description of the present invention, the dumping mechanism of the present invention can be actuated through its dumping cycle in a relatively short period of time as compared with prior mechanisms. Furthermore, the present mechanism is of relatively simple construction and occupies a relatively small longitudinal space behind the cab of the refuse collection vehicle. Other objects and advantages of the present mechanism relative to the prior art will be apparent from the detailed description which follows.

SUMMARY OF THE INVENTION

The invention resides in a mechanism for moving a container from a standing position to a dump position in a relatively short period of time utilizing a combination of a relatively few simple components. The mechanism includes a support frame having a container lift arm supported from the frame by a link member. A container gripping means of any conventional design is mounted on one end of the lift arm. A guide means is supported from the frame assembly and is adapted to engage and guide the movement of the lift arm. A first power means is supported from the frame assembly and is operatively connected to the lift arm. Such first power means is adapted to move the lift arm between a position for gripping a container when in a standing position and a position wherein the container is inverted for dumping its contents. A second power means is provided for moving the lift arm so that the end thereof on which the gripping means is mounted will move in a direction substantially horizontal to the surface upon which the container is standing to thereby allow the operator to move the gripping mechanism laterally to a position adjacent the standing container so that the container can be gripped and then raised thru the dumping cycle.

DESCRIPTION OF THE DRAWINGS

FIG. 9 is a partially schematic view of the hydraulic control circuit for the dumping mechanism.

DESCRIPTION OF THE PREFERRED EMBODIMENT

Figure 1:
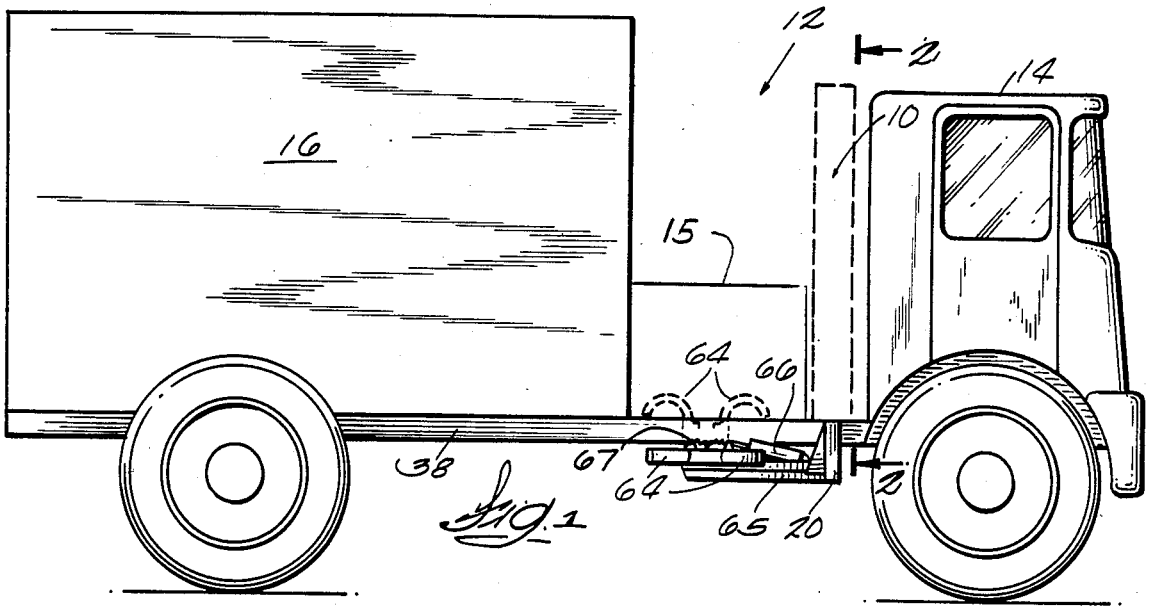
FIG. 1 is a side view of a refuse collection vehicle equipped with a container dumping mechanism (shown schematically) made in accordance with the present invention as shown in FIGS. 2–8.

The dumping mechanism of the present invention as a whole is designated by reference numeral 10 and is shown schematically in FIG. 1 by a dotted line rectangular box. In one embodiment of the present invention, the dumping mechanism 10 is mounted on a vehicle 12 as shown in FIG. 1 directly behind and adjacent to the cab 14 of the vehicle. The vehicle 12 is equipped with a receiving chamber 15 of any suitable design for receiving refuse dumped from container 62 by dumping mechanism 10. Refuse dumped into chamber 15 is periodically transferred into the body 16 of vehicle 12 by any suitable mechanism (not shown). While the dumping mechanism of the present invention is particularly designed for dumping refuse into a refuse collection vehicle, it will be appreciated that it may have other useful applications.

Referring to FIGS. 2–8, the dumping mechanism of the present invention is comprised of the following basic components: a frame assembly 18; a lift arm 20; a track cylinder 22; a lift cylinder 24; a link member 26; and a guide track assembly 28.

Frame assembly 18 is comprised of a substantially vertically extending leg 30, substantially horizontal leg 32 extending from leg 30 and having a downwardly angling portion 34 at the end of leg 32. Frame assembly 18 also includes a horizontally extending base member 36 for mounting the frame assembly on the chassis 38 of the vehicle 12. The means for attaching the frame assembly 18 to the chassis 38 can be accomplished in any suitable manner, such as by welding.

Lift arm 20 is supported from the upper horizontal leg 32 of the frame assembly 18 by link member 26 which is pivotally connected at its upper end to the frame by a pin 40 and is pivotally connected at its lower end to lift arm 20 by a pin 42.

Figure 2:
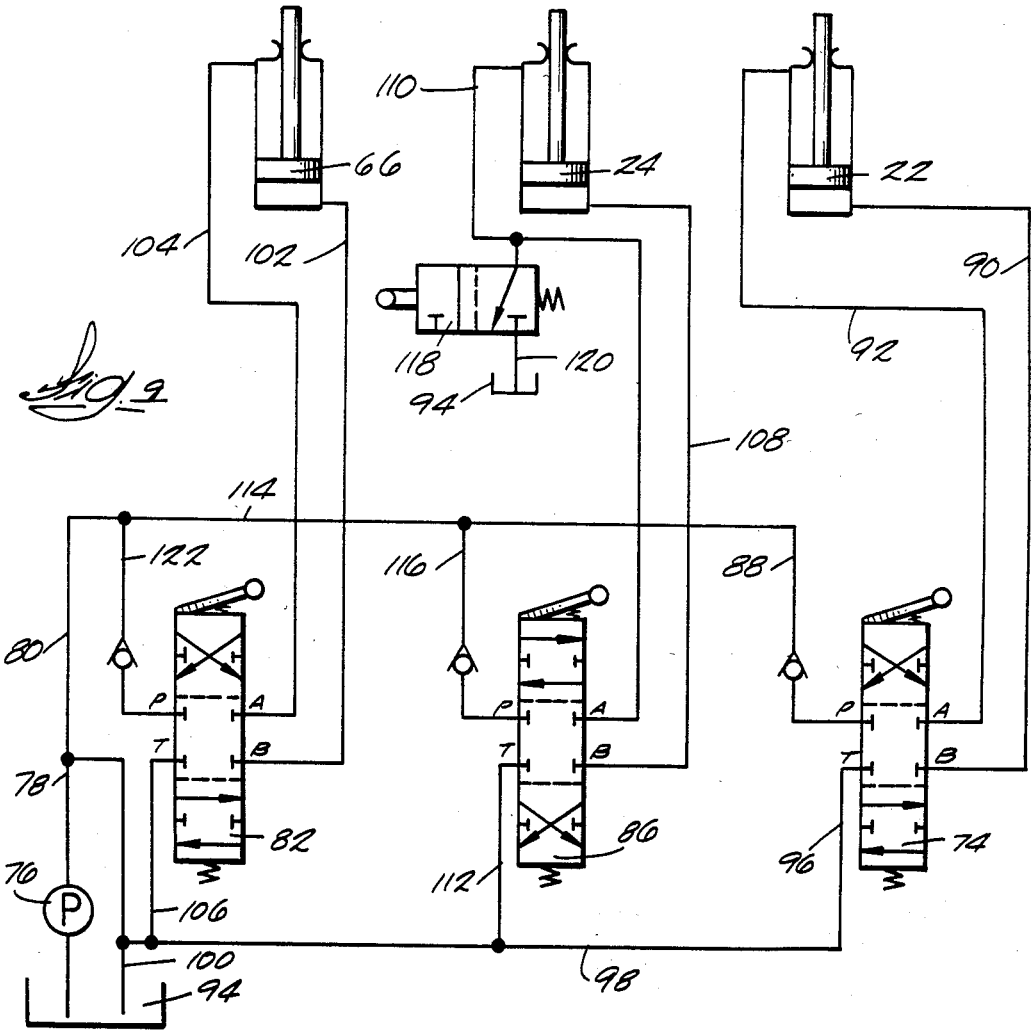
FIG. 2 is a vertical sectional view taken along line 2—2 of FIG. 1.
Figure 2:
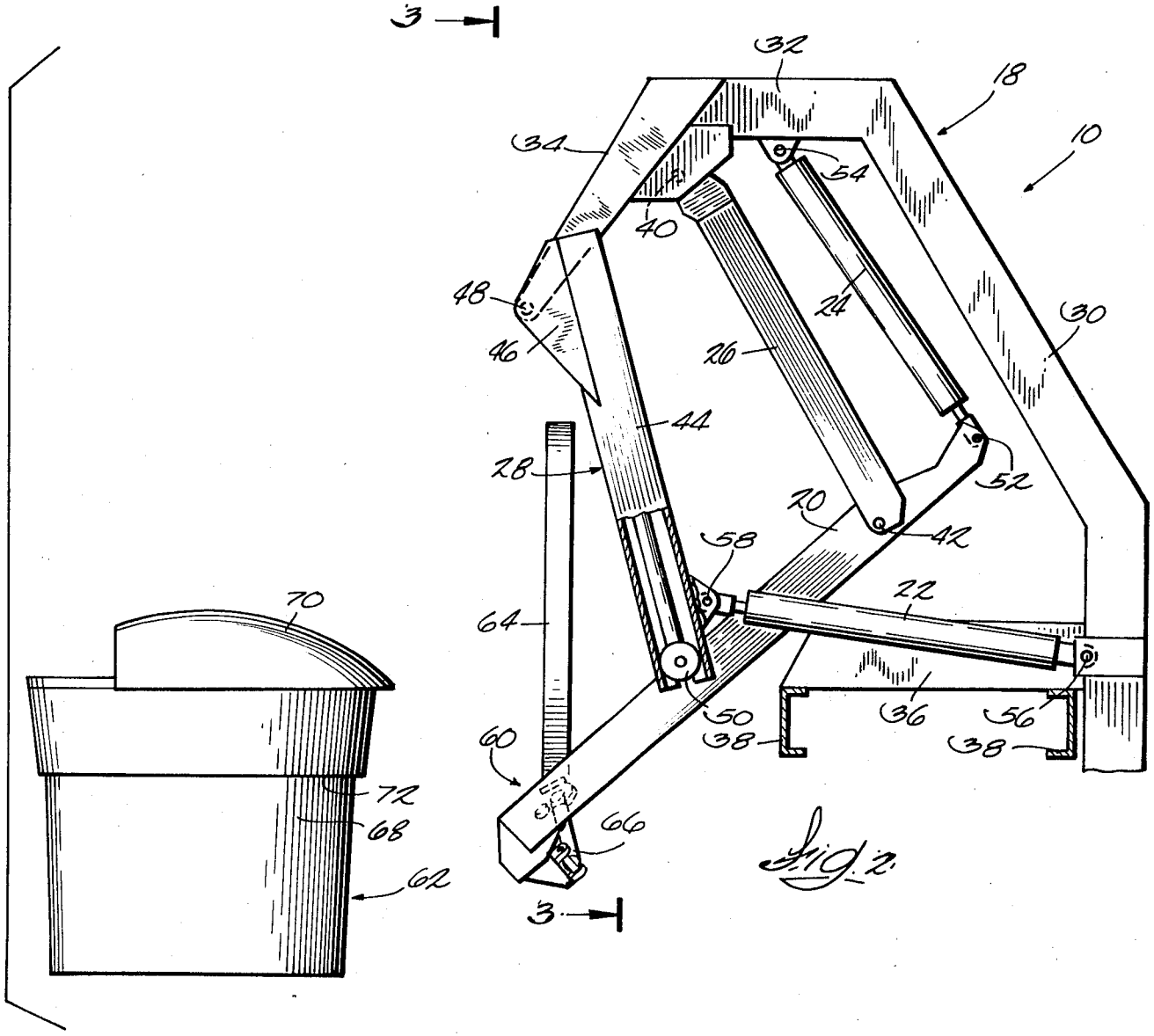
Figure 3:
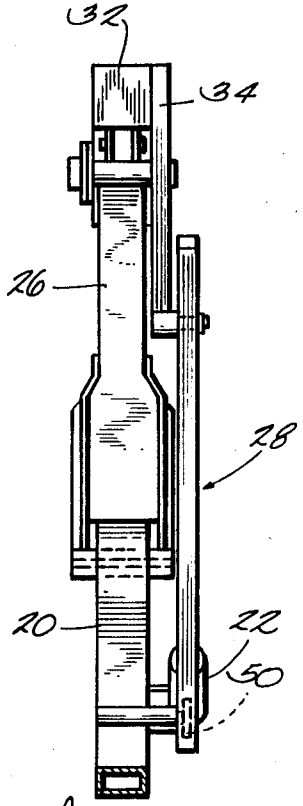
FIG. 3 is a vertical sectional view taken along line 3—3 of FIG. 2.

Lift arm 20 is guided during its dumping movement by track assembly 28. Track assembly 28 is comprised of a track member 44 in the form of a slotted box beam and a bracket 46 mounted on the upper end of member 44 for establishing a pivotal connection of the track assembly to leg 34 of frame 18 by a pin 48. A roller member 50 is rotatively mounted on lift arm 20 and is positioned to ride up and down within the track member 44 as best shown in FIG. 2.

Lift cylinder 24 is pivotally connected at its lower end to the end of lift member 20 by a pin 52 and is pivotally connected at its upper end to horizontal leg 32 of frame 18 by a pin 54.

Track cylinder 22 is pivotally connected at one end to leg 30 of frame assembly 18 by a pin 56 and is pivotally connected at its other end to track assembly 28 by a pin 58.

The dumping mechanism 10 is provided with a container gripper mechanism 60 for gripping and releasing a container 62. Mechanism 60 (FIG. 1) is comprised of a pair of container gripping arms 64, 64 pivotally mounted on a support arm 65 which in turn is fastened to the end of lift arm 20. Arms 64 are actuated between a release position (dotted lines) and a container gripping position (solid lines) by a gripping cylinder 66. Cylinder 66 is connected directly to one arm 64 and the movement of such arm is transmitted to the other arm 64 by a pair of bevel gears 67. The particular construction and operation of the gripper mechanism 60 is not part of the present invention and thus will not be described in detail herein. Another example of a gripper mechanism designed to grip and release a refuse container is shown in U.S. Pat. No. 4,227,849.

Refuse containers 62 may be of any suitable design. The container 62 shown in the drawings is comprised of a refuse containing body portion 68 having a cover member 70 pivotally mounted on the top of the body. The body 68 is provided with a downwardly facing shoulder 72 for engagement by the gripper arms 64 when the arms are moved into gripping engagement with the container 62. The particular construction of container 62 is not part of the present invention and thus will not be described in any further detail herein.

OPERATION

The operation of dumping mechanism 10 will be described with reference to a simplified hydraulic control circuit shown in FIG. 9. It should be understood, however, that the dumping mechanism 10 could be controlled by a hydraulic control circuit other than that shown in FIG. 9. The circuit of FIG. 9 is merely illustrative of circuits which have the capability for effectively operating mechanism 10. In the preferred embodiment, control valves 74, 82 and 86 as shown in FIG. 9 are located outside cab 14 of vehicle 12 with a remote actuation system (not shown) located inside the cab so that the operator need not get out of the cab to operate the dumping mechanism 10.

Referring to FIG. 2, assume, as shown therein, that the refuse vehicle 12 has been stopped opposite a container 62 with the gripper mechanism 60 spaced from the container 62.

The first step is for the operator to actuate valve 74 by pushing the valve handle downwardly. This will cause hydraulic fluid under pressure to flow from pump 76 thru lines 78, 80, 114, 88 to port P of valve 74. The fluid will flow thru valve 74 from port P to port B and then to track cylinder 22 thru line 90. This extends track cylinder 22 until the gripper mechanism 60 is moved to a position immediately adjacent the container 62. Exhaust fluid from cylinder 22 will flow thru line 92 to port A of valve 74 and then thru valve 74 from port A to port T and then to the hydraulic fluid tank 94 thru lines 96, 98 and 100.

The next step is to close the grabber arms 64. This is accomplished by actuating valve 82 by pulling the valve handle back. This will cause hydraulic fluid under pressure to flow from pump 76 thru lines 78, 80, 114, 122 to port P of valve 82. Fluid will flow from port P to port A and then to the rod end of gripping cylinder 66 thru line 104. The gripping cylinder 66 will thereby be retracted to close the gripping arms 64 around container 62. Exhaust fluid from cylinder 66 will flow thru line 102 to port B of valve 82 and then thru valve 82 from port B to port T and then to hydraulic fluid tank 94 thru lines 106, 98 and 100.

The next step is to cause the dumping mechanism to move thru the dumping portion of its dumping cycle. This is accomplished when the operator actuates valve 86 by pulling back on the valve handle of valve 86. This will cause hydraulic fluid to flow from pump 76 thru lines 78, 80, 114, 116 to port P of valve 86. Fluid will flow from port P to port B of valve 86 and then to lift cylinder 24 thru line 108. This will extend lift cylinder 24 to cause the dumping mechanism 10 to be actuated thru the dumping portion of the dumping cycle as illustrated in FIGS. 4–8. Exhaust fluid from cylinder 24 will flow thru line 110 to port A of valve 86 and then thru valve 86 from port A to port T and then to tank 94 thru lines 112, 98, 100. When the mechanism 10 reaches the FIG. 8 position, cover 70 of container 62 will open and the refuse therein will be dumped into chamber 15.

Figure 4:
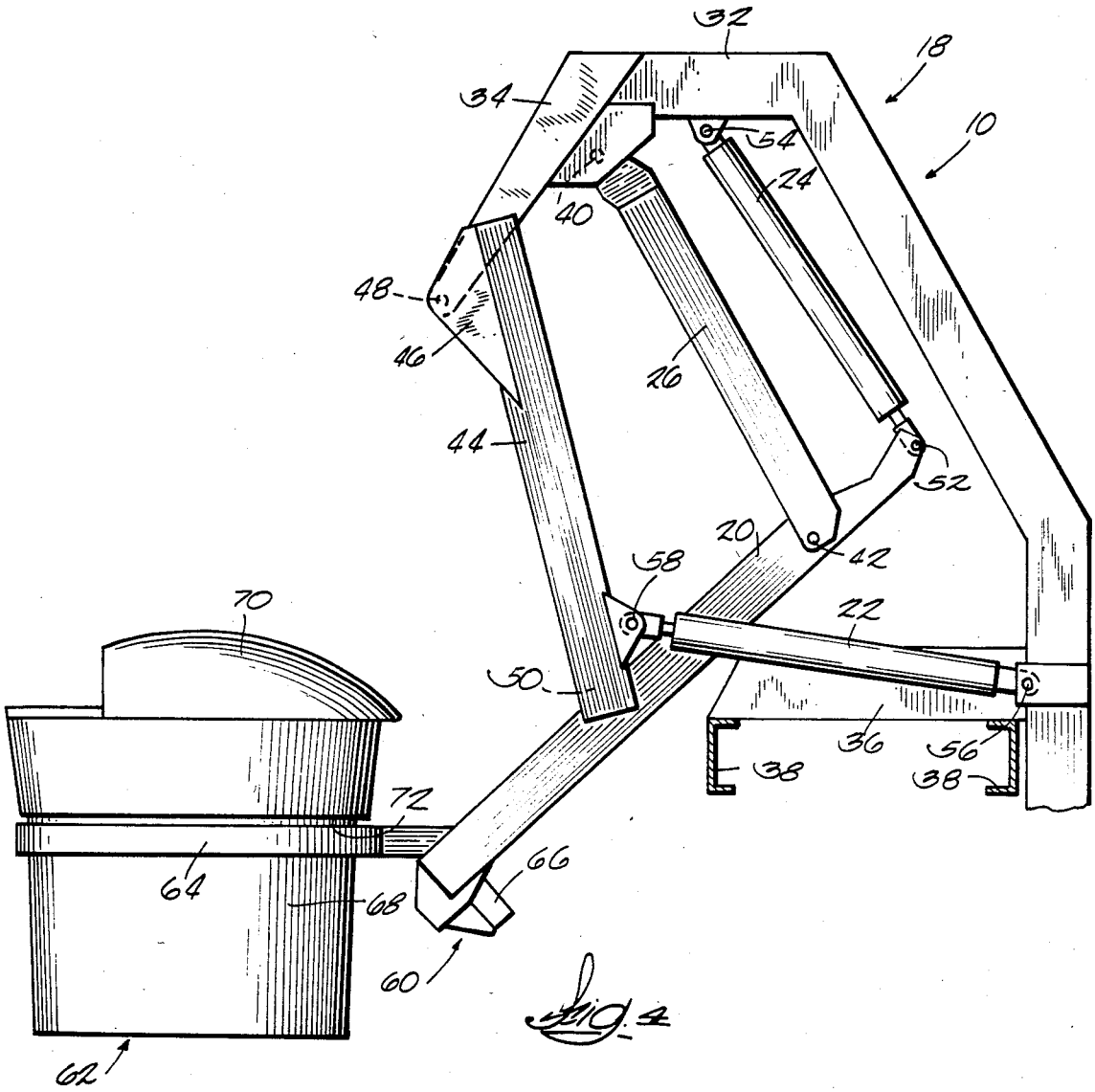
FIGS. 4–8 are a series of partially schematic views (similar to FIG. 2) showing the dumping mechanism in its various positions as it is moved through its dumping cycle.

To set the container back down, the handle of valve 86 is pushed forwardly. Fluid will then flow from pump 76 thru lines 78, 80, 114, 116 to port P of valve 86. Fluid will flow from port P to port A of valve 86 and then to the rod end of cylinder 24 thru line 110. Cylinder 24 will thereby be retracted, causing the dumping mechanism 10 to move from its dump position (FIG. 8) to its down position (FIG. 4).

As the dumping mechanism 10 reaches the last portion of its downward movement (preferably the last 12 inches of downward movement), a selector valve 118 in line 110 will be actuated. This will divert fluid flowing to cylinder 22 to tank 94 thru line 120. This will cause the dumping mechanism 10 and container 62 to float approximately the last 24 inches of movement to thereby prevent the container from slamming down on the ground. Valve 118 (shown only on FIG. 9) can be actuated automatically by any suitable arrangement, such as by mechanical contact by a suitable part of the dumping mechanism as the dumping mechanism reaches the last portion of its downward movement.

The next step is to open the gripping arms 64 to release container 62 from the dumping mechanism. This is accomplished by actuating valve 82 by pushing forward on the valve handle. This will cause hydraulic fluid under pressure to flow from pump 76 thru lines 78, 80, 114, 122 to port P of valve 82. Fluid will flow from port P to port B and then to cylinder 66 thru line 102. The gripping cylinder 66 will thereby be extended to open the gripping arms 64 to thereby release container 62. Exhaust fluid from cylinder 66 will from thru line 104 to port A of valve 82 and then thru valve 82 from port A to port T and then to hydraulic fluid tank 94 through lines 106, 98 and 100.

The final step in the dumping cycle is to retract the gripping mechanism 60 back to its original position as shown in FIG. 2. This is accomplished by actuating valve 74 by pulling back on the valve handle. This will cause hydraulic fluid under pressure to flow from pump 76 through lines 78, 80, 114, 88 to port P of valve 74. Fluid will flow through valve 74 from port P to port A and then to track cylinder 22 through line 92. This will retract cylinder 22 to the FIG. 2 position. Exhaust fluid from track cylinder 22 will flow to port B of valve 74 and then thru valve 74 from port B to port T and then from port T to hydraulic fluid tank 94 thru lines 96, 98 and 100.

The operator moves the vehicle to the next container and the operation of the gripping mechanism 10 as described above is repeated.

The operation of dump mechanism 10 as described above assumes an initial condition as shown in FIG. 2, namely, a situation where the operator has positioned the vehicle with the gripper mechanism 60 spaced from the container 62. In such a situation, it is necessary to first extend track cylinder 22 until the gripper mechanism 60 is moved to a position adjacent container 62. The distance the track cylinder 22 must be extended will depend of course on how close the operator positions the vehicle 12 with respect to the container 62.

Figure 5:
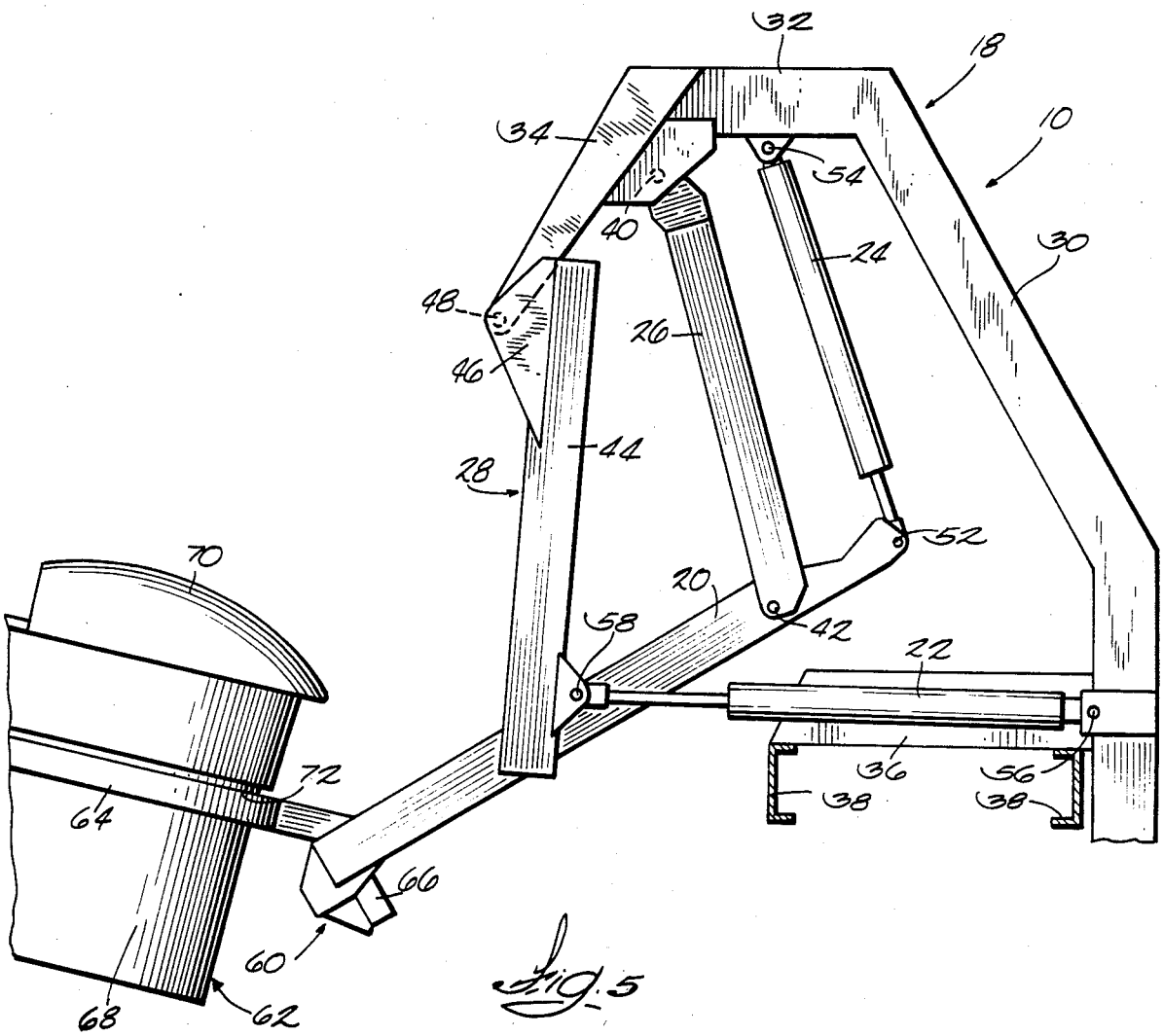
Figure 6:
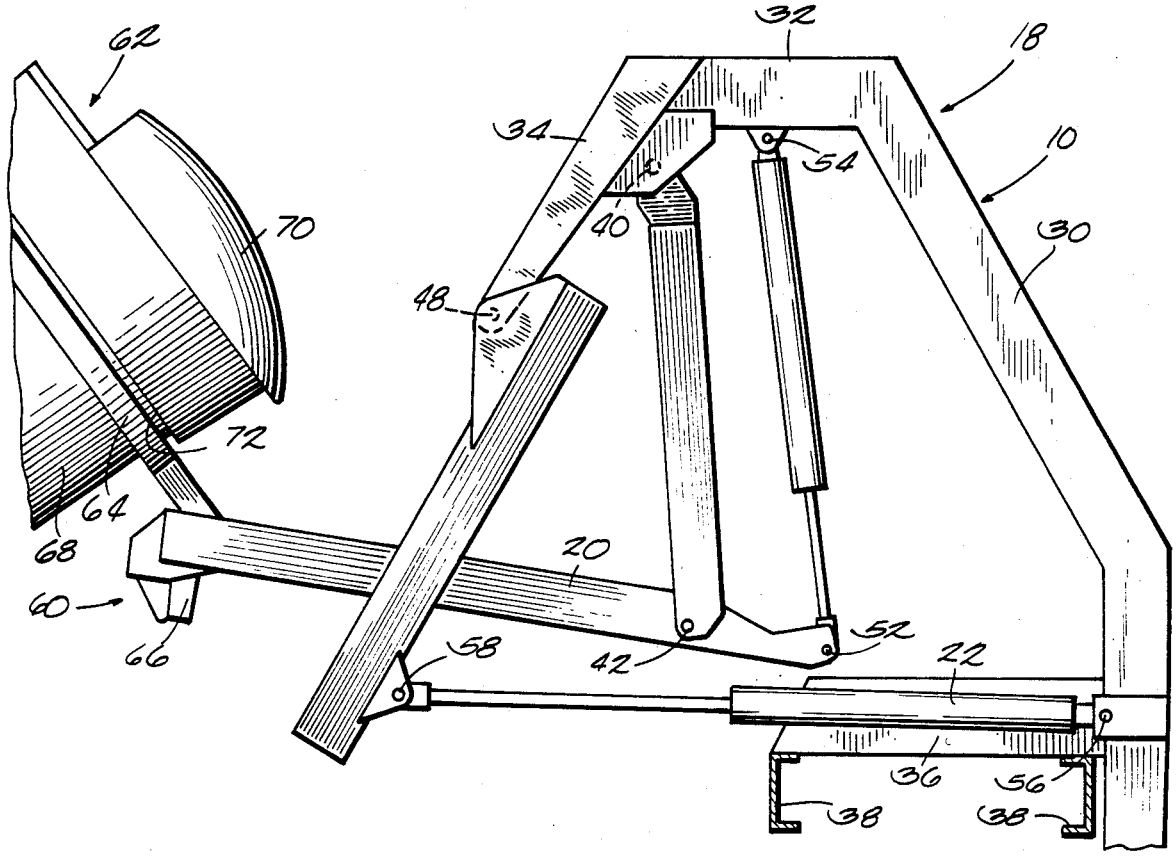
Figure 7:
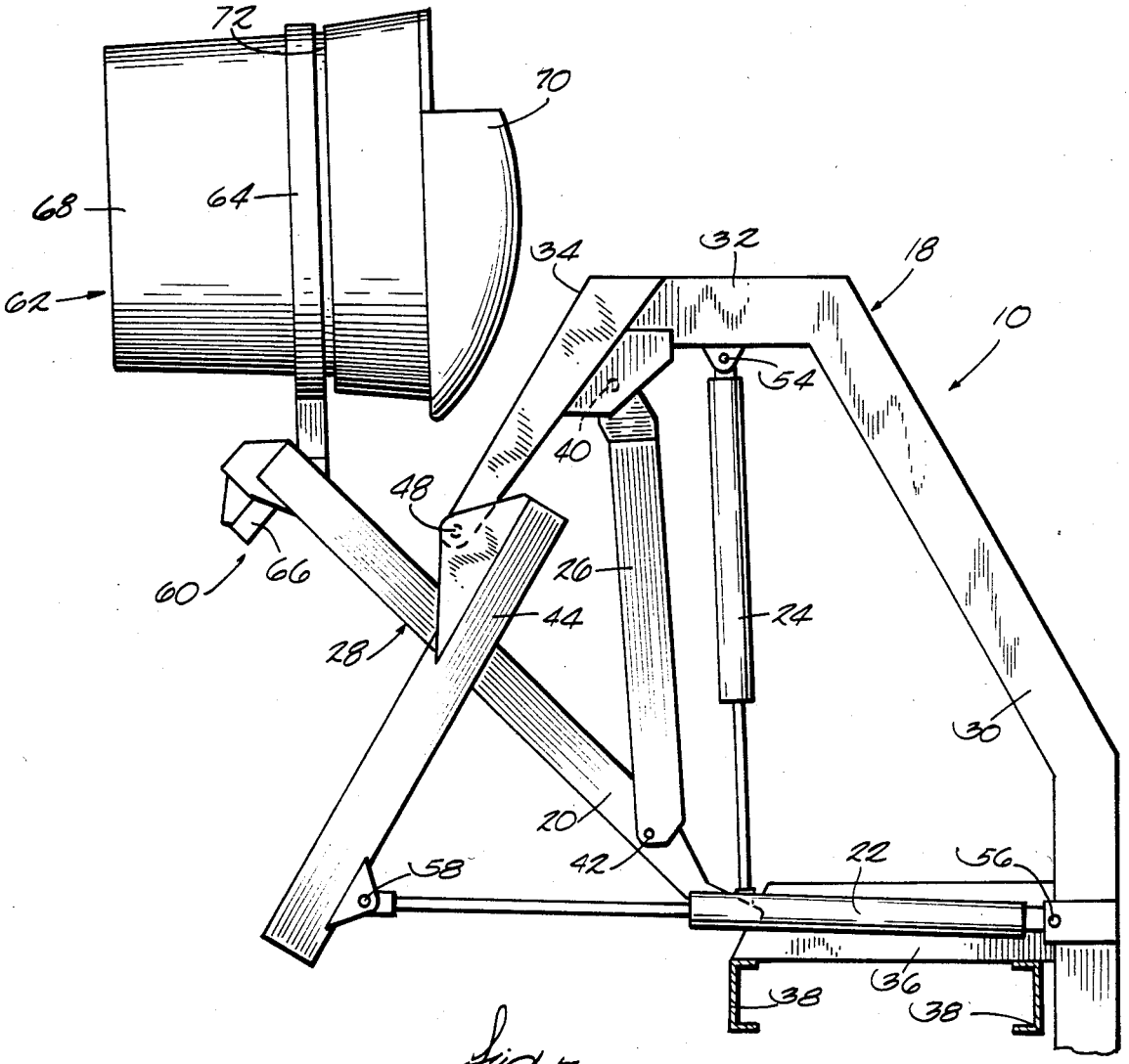
Figure 8:
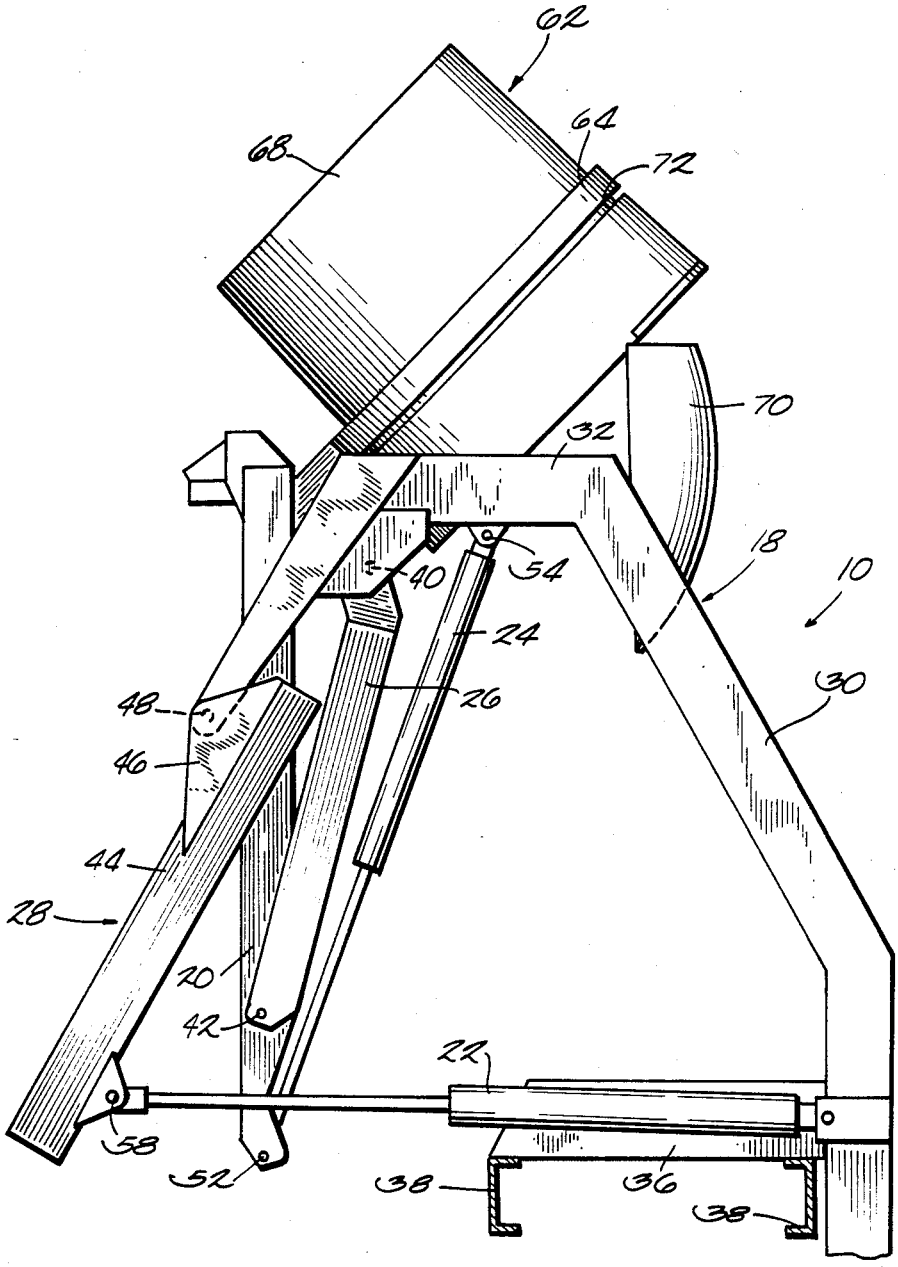

FIGS. 6, 7 and 8 show a situation where the track cylinder is fully extended (about 36" in the preferred embodiment). FIG. 5 shows a situation where the track cylinder 22 is partially extended and FIG. 4 shows a situation where the operator has positioned the vehicle with the gripper mechanism 60 sufficiently close to the container 62 that no extension of the track cylinder is required. An experienced operator can often position the vehicle as shown in FIG. 4, thus eliminating the necessity of actuating the track cylinder at either the beginning or the end of the dumping cycle. This is the preferred method of operation since it reduces overall operating time.

It should be noted at this point that one of the important inherent advantages of the dumping mechanism 10 of this invention is its ability to perform a substantially uniform dumping movement irrespective of whether the track cylinder is fully extended, partially extended or not extended at all. To state it another way, the dumping mechanism 10 will move the container 62 to essentially the same dumping position (FIG. 8) with respect to the vehicle irrespective of the degree to which the track cylinder is extended. Similarly the emptied container 62 will be set down on the grind at the same location from which it was raised originally.

It will be appreciated from the above description that the dumping mechanism of the present invention can be actuated through its dumping cycle in a relatively short period of time as compared with prior mechanisms and this can be accomplished by a single operator who can remain in the vehicle cab during the entire operation. Furthermore, the present mechanism is of relatively simple construction and occupies a relatively small longitudinal space behind the cab of the vehicle.

It should also be noted that the major components of the mechanism are comprised of link members as opposed to slide members. This simplifies the hydraulic plumbing arrangement for the hydraulic cylinders and requires flexibility for bending at the link joints only.

It is also important that the lift mechanism operate so that most of the container tipping movement occurs at the top part of the dumping arc. Furthermore, the mechanism, is designed so that the mechanical lift advantage is nearly constant throughout the dumping cycle, i.e., if the container can be initially lifted off the ground the rest of the dumping cycle can be completed.

I claim:

1. A mechanism mounted on a vehicle for moving a container from a standing position to an inverted position over the vehicle for dumping the contents of the container into the vehicle:

(a) a support frame assembly means (18);

(b) a lift arm (20) supported from said frame assembly means;

(c) support means (26) for supporting said lift arm from said frame assembly means;

(d) a container gripping means (60) mounted on one end of said lift arm, said container gripping means adapted to move between a container gripping position and a container release position;

(e) a guide means (28) supported from said frame assembly and pivotally connected thereto and adapted to engage said lift arm at a point intermediate the ends thereof and guide the movement of said lift arm as said lift arm is moved between a position for gripping a container when in a standing position and a position wherein the container is inverted for dumping its contents into the vehicle;

(f) a first power cylinder means (24) supported on said frame assembly and operatively connected to said lift arm, said first power cylinder means adapted to move said lift arm between a position for gripping a container when in an upright standing position to a second position in which the container assumes an inverted position for dumping the contents thereof into the vehicle, said first power cylinder means being effective upon energization thereof to move the container from an upright standing position to an inverted dumping position over the vehicle; and (g) a second power cylinder means (22) supported on said support frame assembly means and operatively connected to said guide means, said second power cylinder means adapted to move said lift arm so that the end thereof on which said gripping means is mounted will move in a direction substantially horizontal to the surface upon which said container is standing.

2. A mechanism according to claim 1 in which said first power cylinder means is pivotally connected at one end to said frame assembly means and is pivotally connected at the other end to the end of said lift arm opposite from that on which said gripping means is mounted.

3. A mechanism according to claim 2 in which said lift arm support means is in the form of a link member with one end thereof pivotally connected to said frame assembly means and with the other end thereof pivotally connected to said lift arm at a point intermediate the ends thereof.

4. A mechanism according to claim 3 in which said guide means is in the form of a track member adapted for engagement with a roller mounted on said lift arm.

5. A mechanism mounted on a refuse collection vehicle for lifting a container from a standing position at one side of the vehicle to an inverted position over the vehicle for dumping the contents of the container into the vehicle:

(a) a support frame assembly means (18), said support frame assembly means including a substantially vertically extending leg (30) and a substantially horizontal leg (32, 34) extending from the upper end of said vertical leg;

(b) a lift arm (20) supported from said horizontal leg of said support frame assembly means;

(c) support means (26) for supporting said lift arm from said horizontal leg of said frame assembly means, said support means including a link member pivotally connected at its upper end to said horizontal leg of said frame assembly and pivotally connected at its lower end to said lift arm at a point intermediate the ends of said lift arm;

(d) a container gripping means (60) mounted on one end of said lift arm, said container gripping means adapted to move between a container gripping position and a container release position;

(e) a guide means (28) supported from said horizontal leg of said frame assembly and adapted to engage and guide the movement of said lift arm as said lift arm is moved between a position for gripping a container when in a standing position and a position wherein the container is inverted for dumping its contents, said guide means including a track member pivotally connected at its upper end to said horizontal leg of said frame assembly and adapted for engagement with a roller member mounted on said lift arm, said roller member mounted on said lift arm at a point intermediate the ends thereof;

(f) a power cylinder means (24) supported on said frame assembly and operatively connected to said lift arm, said power cylinder means adapted to move said lift arm between a position for gripping a container when in an upright standing position to a second position in which the container assumes an inverted position for dumping the contents thereof, said power cylinder means being effective upon energization thereof to move the container from an upright standing position to an inverted dumping position; and (g) a power track cylinder (22) pivotally connected at one end to said vertical leg of said support frame assembly and pivotally connected at its other end to said track member of said guide means, said power track cylinder adapted to move said lift arm so that the end thereof on which said gripping means is mounted will move in a direction substantially horizontal to the surface upon which the container is standing.

6. A mechanism for moving a container from a standing position to a dump position and from a dump position to a standing position:

(a) a support frame assembly means (18), said support frame assembly means including a substantially vertically extending leg (30) and a substantially horizontal leg (32, 34) extending from the upper end of said vertical leg;

(b) a lift arm (20) supported from said horizontal leg of said support frame assembly means;

(c) support means (26) for supporting said lift arm from said horizontal leg of said frame assembly means;

(d) a container gripping means (60) mounted on one end of said lift arm, said container gripping means adapted to move between a container gripping position and a container release position;

(e) a guide means (28) supported from said horizontal leg of said frame assembly and adapted to engage and guide the movement of said lift arm as said lift arm is moved between a position for gripping a container when in a standing position and a position wherein the container is inverted for dumping its contents;

(f) a first hydraulic power means (24) supported from said horizontal leg of said support frame assembly and operatively connected to the end of said lift arm opposite from that upon which said gripping means is mounted, said first hydraulic power means adapted to move said lift arm between a first position for gripping a container in a standing position and a second position wherein the container is inverted for dumping its contents, said first hydraulic power means further adapted to move said lift arm between a position wherein the container is inverted for dumping its contents and a position for setting the container upon the ground in a standing position, the position of the container relative to said lift arm remaining constant as said lift arm is moved between its first and second positions;

(g) a second hydraulic power means (22) supported on said vertical leg of said support frame assembly means, said second hydraulic power means pivotally connected to said guide means and adapted to move said lift arm so that the end thereof on which said gripping means is mounted will move in a direction substantially horizontal to the surface upon which the container is standing; and (h) hydraulic control means for controlling the movement of said first and second hydraulic power means.

7. A mechanism according to claim 6 in which said hydraulic control means includes a selector valve means (118) operable to divert flow of hydraulic fluid flowing to said first hydraulic power means during the last portion of the downward movement of said lift arm to thereby prevent the container from slamming down on the ground.

8. A refuse collection vehicle for automatically dumping a refuse container located alongside a roadway comprising:

(a) a vehicle frame (38);

(b) a receiving chamber (15) mounted on said frame and having a top opening for receiving refuse;

(c) a mechanism (10) mounted on said frame for automatically moving a refuse container located in a standing position alongside a roadway to a dump position wherein the container is inverted for dumping its contents into said receiving chamber, said mechanism including:

(1) a support frame assembly means (18) mounted on said vehicle frame, said frame assembly means including a substantially vertically extending leg (30) and a substantially horizontal leg (32, 34) extending from the upper end of said vertical leg;

(2) a lift arm (20) supported from said frame assembly means;

(3) support means (26) for supporting said lift arm from said frame assembly means, said support means being in the form of a link member pivotally connected at one end to said horizontal leg of said frame assembly means and pivotally connected at the other end to said lift arm at a point intermediate its ends;

(4) a container gripping means (60) mounted on said lift arm, said container gripping means adapted to move between a container gripping position and a container release position;

(5) a guide means (28) supported from said frame assembly and adapted to engage and guide the movement of said lift arm as said lift arm is moved between a position for gripping a container when in a standing position and a position wherein the container is inverted for dumping its contents;

(6) a first power cylinder means (24) supported on said frame assembly and operatively connected to said lift arm, said first power cylinder means adapted to move said lift arm between a position for gripping a container when in an upright standing position to a second position in which the container assumes an inverted position for dumping the contents thereof, said first power cylinder means being effective upon energization thereof to move the container from an upright standing position to an inverted dumping position; and (7) a second power cylinder means (22) supported on said support frame assembly means and operatively connected to said guide means, said second power cylinder means adapted to move said lift arm so that the end thereof on which said gripping means is mounted will move in a direction substantially horizontal to the surface upon which said container is standing.

9. A vehicle according to claim 8 in which said first power cylinder means is pivotally connected at one end to said horizontal leg of said frame assembly means and is pivotally connected at the other end to the end of said lift arm opposite from that on which said gripping means is mounted.

10. A vehicle according to claim 9 in which one end of said guide means is pivotally connected to said frame assembly and in which said guide means engages said lift arm at a point intermediate the ends thereof.

11. A vehicle according to claim 10 in which said guide means is in the form of a track member adapted for engagement with a roller mounted on said lift arm.

12. A mechanism for moving a container from a standing position to a dump position:

(a) a support frame assembly means (18);

(b) a lift arm (20) supported from said frame assembly means;

(c) support means (26) for supporting said lift arm from said frame assembly means;

(d) a container gripping means (60) mounted on one end of said lift arm, said container gripping means adapted to move between a container gripping position and a container release position;

(e) a guide means (28) supported from said frame assembly and adapted to engage and guide the movement of said lift arm as said lift arm is moved between a position for gripping a container when in a standing position and a position wherein the container is inverted for dumping its contents, one end of said guide means is pivotally connected to said frame assembly and said guide means engages said lift arm at a point intermediate the ends thereof, said guide means is in the form of a track member (44) adapted for engagement with a roller (50) mounted on said lift arm;

(f) a power cylinder means (24) supported on said frame assembly and pivotally connected to the other end of said lift arm, said power cylinder means adapted to move said lift arm between a position for gripping a container when in an upright standing position to a second position in which the container assumes an inverted position for dumping the contents thereof, said power cylinder means being effective upon energization thereof to move the container from an upright standing position to an inverted dumping position.

13. A mechanism for moving a container from a standing position to a dump position:

(a) a support frame assembly means (18), said support frame assembly means including a substantially vertically extending leg (30) and a substantially horizontal leg (32, 34) extending from the upper end of said vertical leg;

(b) a lift arm (20) supported from said horizontal leg of said support frame assembly means;

(c) lift arm support means (26) for supporting said lift arm from said horizontal leg of said frame assembly means, said lift arm support means is in the form of a link member with one end thereof pivotally connected to said horizontal leg of said frame assembly means and with the other end thereof pivotally connected to said lift arm at a point intermediate the ends thereof;

(d) a container gripping means (60) mounted on one end of said lift arm, said container gripping means adapted to move between a container gripping position and a container release position;

(e) a guide means (28) supported from said horizontal leg of said frame assembly and adapted to engage and guide the movement of said lift arm as said lift arm is moved between a position for gripping a container when in a standing position and a position wherein the container is inverted for dumping its contents;

(f) a power cylinder means (24) supported on said frame assembly and operatively connected to said lift arm, said power cylinder means adapted to move said lift arm between a position for gripping a container when in an upright standing position to a second position in which the container assumes an inverted position for dumping the contents thereof, said power cylinder means being effective upon energization thereof to move the container from an upright standing position to an inverted dumping position; and said lift arm having a roller mounted thereon intermediate the ends thereof and in which said guide means is in the form of a track member adapted for engagement with said roller.

14. A mechanism for moving a container from a standing position to a dump position:

(a) a support frame assembly means (18), said support frame assembly means including a substantially vertically extending leg (30) and a substantially horizontal leg (32, 34) extending from the upper end of said vertical leg;

(b) a lift arm (20) supported from said horizontal leg of said support frame assembly means;

(c) support means (26) for supporting said lift arm from said horizontal leg of said frame assembly means;

(d) a container gripping means (60) mounted on one end of said lift arm, said container gripping means adapted to move between a container gripping position and a container release position;

(e) a guide means (28) supported from said horizontal leg of said frame assembly and adapted to engage and guide the movement of said lift arm as said lift arm is moved between a position for gripping a container when in a standing position and a position wherein the container is inverted for dumping its contents;

(f) a power cylinder means (24) supported on said frame assembly and operatively connected to said lift arm, said power cylinder means adapted to move said lift arm between a position for gripping a container when in an upright standing position to a second position in which the container assumes an inverted position for dumping the contents thereof, said power cylinder means being effective upon energization thereof to move the container from an upright standing position to an inverted dumping position;

(g) a second power means (22) supported on said vertical leg of said support frame assembly means, said second power means pivotally connected to said guide means and adapted to move said lift arm so that the end thereof on which said gripping means is mounted will move in a direction substantially horizontal to the surface upon which the container is standing.

* * * * *